US008245683B2

(12) United States Patent
Taki et al.

(10) Patent No.: US 8,245,683 B2
(45) Date of Patent: Aug. 21, 2012

(54) ENGINE FOR VEHICLE

(75) Inventors: Masafumi Taki, Saitama (JP); Hisashi Sakuyama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 538 days.

(21) Appl. No.: 12/550,120

(22) Filed: Aug. 28, 2009

(65) Prior Publication Data

US 2010/0050976 A1 Mar. 4, 2010

(30) Foreign Application Priority Data

Sep. 2, 2008 (JP) ..... 2008-225191

(51) Int. Cl.
*F02B 75/22* (2006.01)

(52) U.S. Cl. ..... 123/195 R; 123/195 A; 123/195 AC; 123/53.1

(58) Field of Classification Search ..... 123/195 R, 123/195 A, 195 AC, 53.1, 195 C; 180/219, 180/291, 376
See application file for complete search history.

(56) References Cited

U.S. PATENT DOCUMENTS 5,975,041 A * 11/1999 Narita et al. ..... 123/196 R
5,992,355 A * 11/1999 Shichinohe et al. ..... 123/41.56
6,213,063 B1 * 4/2001 Nakano et al. ..... 123/41.44
6,484,607 B2 * 11/2002 Shichinohe et al. ..... 74/730.1
7,478,612 B2 * 1/2009 Shiozaki et al. ..... 123/41.1
7,591,241 B2 * 9/2009 Ishikawa ..... 123/195 R
7,823,678 B2 * 11/2010 Okano et al. ..... 180/230
2005/0229894 A1 * 10/2005 Okano et al. ..... 123/197.1
2007/0267240 A1 * 11/2007 Inui et al. ..... 180/291

FOREIGN PATENT DOCUMENTS

JP 3994149 B2 8/2007

* cited by examiner

*Primary Examiner* — Noah Kamen
*Assistant Examiner* — Hung Q Nguyen
(74) *Attorney, Agent, or Firm* — Birch, Stewart, Kolasch & Birch, LLP

(57) ABSTRACT

A vehicle engine includes the crankcase for supporting thereon the crankshaft, the input shaft and the output shaft, with the crankcase being composed of a left case half and a right case half which are joined to each other at a plane orthogonal to the axis of the crankshaft. A starter motor together with a speed sensor, for detecting the vehicle speed from the rotation of a gear in a transmission, are mounted to an upper surface of the crankcase. The starter motor is arranged at a portion, just above the input shaft, of the upper surface of the crankcase, while the speed sensor for detecting the rotation of a gear on the output shaft is arranged at a portion, just above the output shaft, of the upper surface of the crankcase. The crankcase is formed with a raised wall for covering one side surface of the speed sensor.

20 Claims, 7 Drawing Sheets

ENGINE FOR VEHICLE

CROSS-REFERENCE TO RELATED APPLICATIONS

The present application claims priority under 35 USC 119 to Japanese Patent Application No. 2008-225191 filed on Sep. 2, 2008 the entire contents of which are hereby incorporated by reference.

BACKGROUND OF THE INVENTION

1. Field of the Invention

The present invention relates to a vehicle engine mounted on a body frame, in which a starter motor and a speed sensor for detecting the vehicle speed from the rotation of a gear in a transmission are mounted to an upper surface of a crankcase supporting thereon a crankshaft, an input shaft of the transmission, and an output shaft, disposed on the rear side of the input shaft, of the transmission.

2. Description of Background Art

A vehicle engine is disclosed, for example, in Japanese Patent No. 3994149 that includes a starter motor and a speed sensor for detecting the vehicle speed.

In the vehicle engine disclosed in Japanese Patent No. 3994149, a crankcase is composed of an upper case half and a lower case half into which the crankcase is divided in the upper and lower sides. A crankshaft and an input shaft and an output shaft of a transmission, which are laid out on one horizontal plane, are held between the upper and lower case halves. In addition, a starter motor is mounted to a portion, directly above an intermediate position between the crankshaft and the input shaft, of an upper surface of the upper case half. Further, a speed sensor is mounted to a portion, directly above the input shaft, of the upper surface of the upper case half.

In such a configuration as set forth above, the division of the crankcase into the upper and lower case halves makes it necessary for the crankshaft, the input shaft and the output shaft to be laid out on one horizontal plane. In addition, the arrangement of the starter motor at a portion, directly above an intermediate position between the crankshaft and the input shaft, of the crankcase makes it difficult for the crankcase to have a compact form. In addition, since the speed sensor is disposed at a portion directly above the input shaft which is comparatively near the cylinder, the speed sensor is liable to be influenced by the heat generated by the cylinder.

SUMMARY AND OBJECTS OF THE INVENTION

The present invention has been made in consideration of the above-mentioned circumstances. Accordingly, it is an object of an embodiment of the present invention to provide a vehicle engine in which the degree of freedom in laying out a crankshaft, an input shaft and an output shaft is enhanced, a crankcase can be designed to have a compact form, and a speed sensor is less liable to be influenced by the heat of a cylinder.

In order to attain the above object, according to an embodiment of the present invention a vehicle engine is mounted on a body frame, including a crankcase for supporting a crankshaft, an input shaft of a transmission, and an output shaft, disposed on the rear side of the input shaft, of the transmission, with the crankshaft including a left case half and a right case half which are jointed to each other at a plane orthogonal to the axis of the crankshaft, and with a starter motor and a speed sensor, for detecting the vehicle speed from rotation of a gear in the transmission, being mounted to an upper surface of the crankcase, the starter motor is disposed on a portion, directly above the input shaft, of the upper surface of the crankcase, the speed sensor for detecting the rotation of a gear on the output shaft as the vehicle speed is disposed on a portion, directly above the output shaft, of the upper surface of the crankcase, and the crankcase is formed with a raised wall for covering one side surface of the speed sensor.

In addition, according to an embodiment of the present invention a drive sprocket for driving a rear wheel is firmly attached to an end portion, projecting to the outer side of the crankcase, of the output shaft, with a sprocket cover for covering an outside surface of the drive sprocket being mounted to the crankcase. The sprocket cover is configured to overlap with at least a part of the other side surface of the speed sensor in a side view.

According to an embodiment of the present invention a cylinder rising from an upper surface of a front portion of the crankcase is disposed so that an axis thereof has an offset from the center of the crankshaft toward the side opposite to the side of the starter motor.

Furthermore, according to an embodiment of the present invention a hanger boss is connected to an engine hanger bracket provided on the body frame and is formed at a rear surface of the crankcase located on the rear side of the output shaft. A rear fork for supporting a rear wheel is swingably supported on the hanger boss and the engine hanger bracket. In addition, the engine hanger bracket corresponds to a first engine hanger bracket 15A in an embodiment of the present invention described later, and the hanger boss corresponds to a first hanger boss 17 in the embodiment.

According to an embodiment of the present invention, the crankcase is composed of the left case half and the right case half joined to each other at a plane orthogonal to the axis of the crankshaft, and the crankshaft, the input shaft and the output shaft are supported by the left and right case halves. Therefore, the three axes can be laid out to be staggered from each other in the vertical direction, so that it is possible to contrive a compact crankcase.

In addition, although the upper surface of the crankcase is narrowed for making the crankcase compact, the configuration in which the starter motor is arranged at a portion, directly above the input shaft, of the upper surface of the crankcase and the speed sensor is arranged at a portion, directly above the output shaft, of the upper surface of the crankcase ensures a high space efficiency for the arrangement. Consequently, an increase in engine size due to the starter motor and the speed sensor can be obviated.

Moreover, since the speed sensor arranged at the portion directly above the output shaft is spaced sufficiently from the cylinder, the speed sensor is less liable to be influenced by the heat of the cylinder.

Further, since the crankcase is formed with the raised portion for covering one side surface of the speed sensor, debris or foreign matter such as earth and sand, flying stones, etc. that may impact with the speed sensor from one outer side can be prevented by the raised wall. This eliminates the need for a protective cover used exclusively for the speed sensor.

According to an embodiment of the present invention, debris or foreign matter such as earth and sand, flying stones, etc. that may impact with the speed sensor from the other side can be prevented by utilizing the sprocket cover. This also eliminates the need for a protective cover used exclusively for the speed sensor.

According to an embodiment of the present invention, the upper surface, projecting toward the rear side of the cylinder, of the crankcase is broadened, so that it is facilitated to mount the starter motor and the speed sensor to the projecting upper surface.

According to an embodiment of the present invention, the rear fork is supported by the hanger boss provided on the rear side of the output shaft. Therefore, debris or foreign matter such as flying stones, earth and sand, etc. that may impact with the speed sensor from the rear side can be prevented by the hanger boss and the rear fork.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Now, a mode for carrying out the present invention will be described below, based on a preferred embodiment shown in the accompanying drawings.

Figure 1:
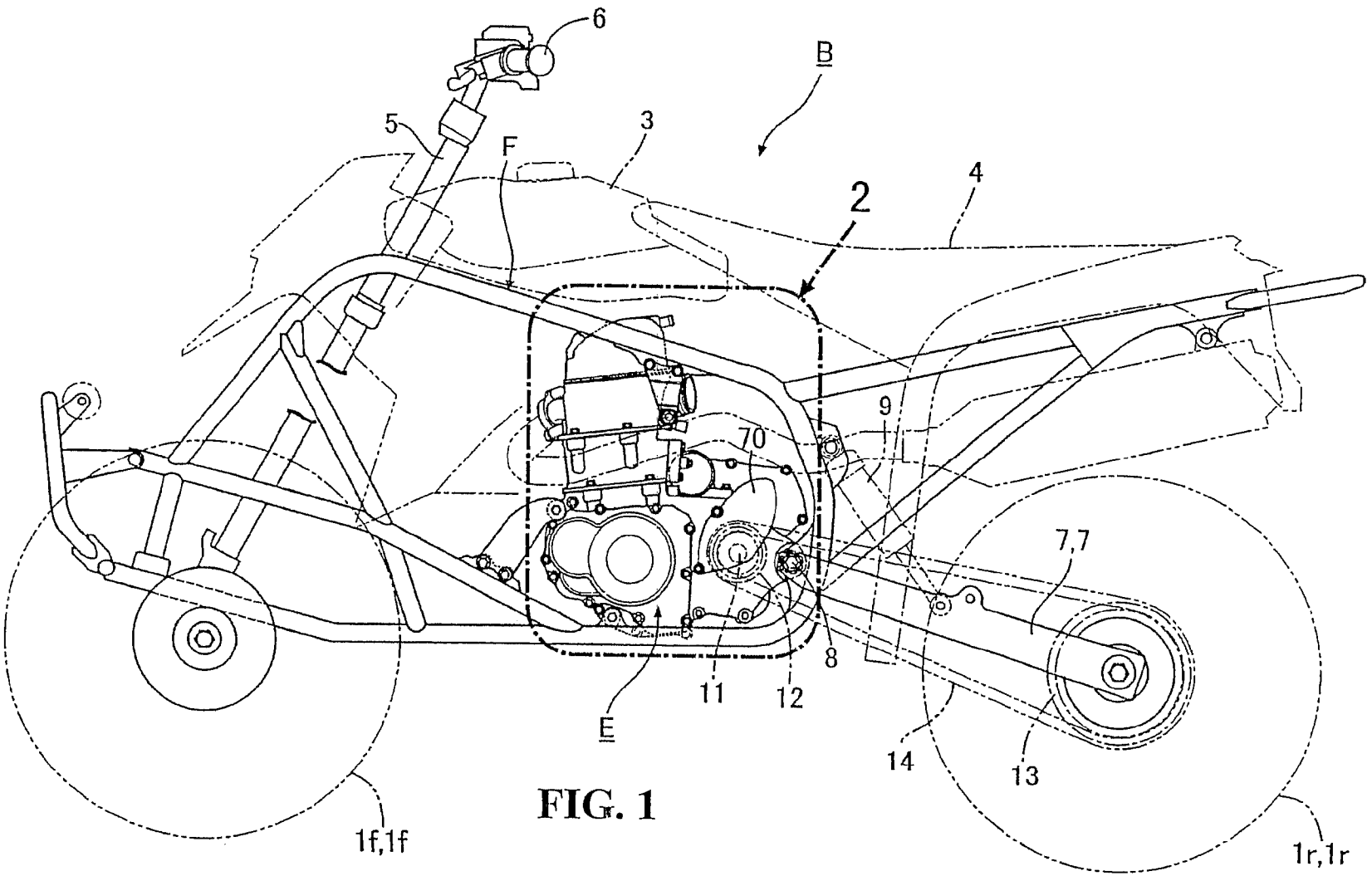
FIG. 1 is a side view of a four-wheel buggy according to an embodiment of the present invention.

FIG. 1 illustrates a four-wheel buggy B configured as a saddle ride type vehicle in which a left-right pair of front wheels 1*f*, 1*f* are suspended from front portions of a body frame F, a left-right pair of rear wheels 1*r*, 1*r* are suspended on the rear side thereof and an engine E is mounted on a central portion of the body frame F, with its crankshaft 2 directed in the left-right direction of the vehicle. A fuel tank 3 is mounted to an upper front portion of the body frame F with a saddle 4 being mounted on the rear side thereof. In addition, a bar-type steering handle 6 for steering the front wheels 1*f*, 1*f* is rotatably supported on a head pipe 5 fixedly provided at a front end portion of the body frame F.

A left-right pair of rear forks 7, 7 are vertically swingably connected to the body frame F and the engine E through a pivot shaft 8. The rear wheels 1*r*, 1*r* are rotatably supported on rear end portions of the rear forks 7, 7, and a rear shock absorber 9 is mounted between each of the rear forks 7, 7 and the body frame F. In this manner, the rear wheels 1*r*, 1*r* are suspended from the body frame F.

The engine E has an output shaft 11 projecting from a left side surface of a rear portion thereof, and a drive sprocket 12 is firmly attached to the outer end of the output shaft 11. A transmission chain 14 is wrapped around the drive sprocket 12 and a driven sprocket 13 which is firmly attached to a hub of the rear wheel 1*r* on the left side, correspondingly to the drive sprocket 12. The rear wheels 1*r*, 1*r* are driven through these components.

Figure 2:
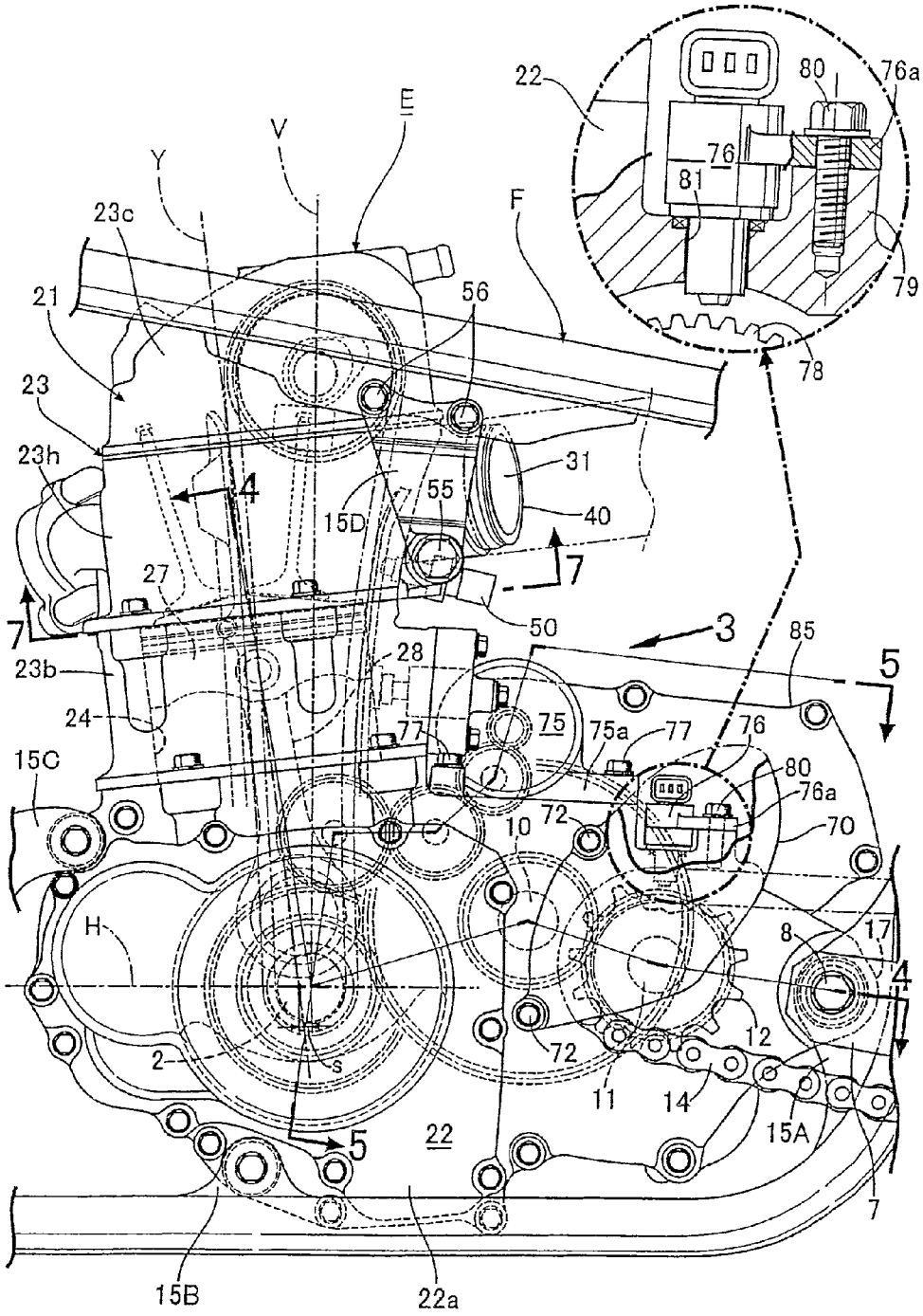
FIG. 2 is an enlarged view of a part 2 of FIG. 1.

In FIG. 2, the body frame F is provided with pairs of first to fourth engine hanger brackets 15A, 15A to 15D, 15D which are disposed respectively facing both left and right side surfaces of the engine E. The first engine hanger brackets 15A, 15A participate in supporting a rear end portion of the engine E and the rear forks 7, 7; the second engine hanger brackets 15B, 15B engage in supporting a somewhat-front lower portion of the engine E; the third engine hanger brackets 15C, 15C participate in supporting a front end portion of the engine E; and the fourth engine hanger brackets 15D, 15D engage in supporting an upper portion of the engine E. The engine hanger brackets are connected to the engine E by use of bolts.

Figure 4:
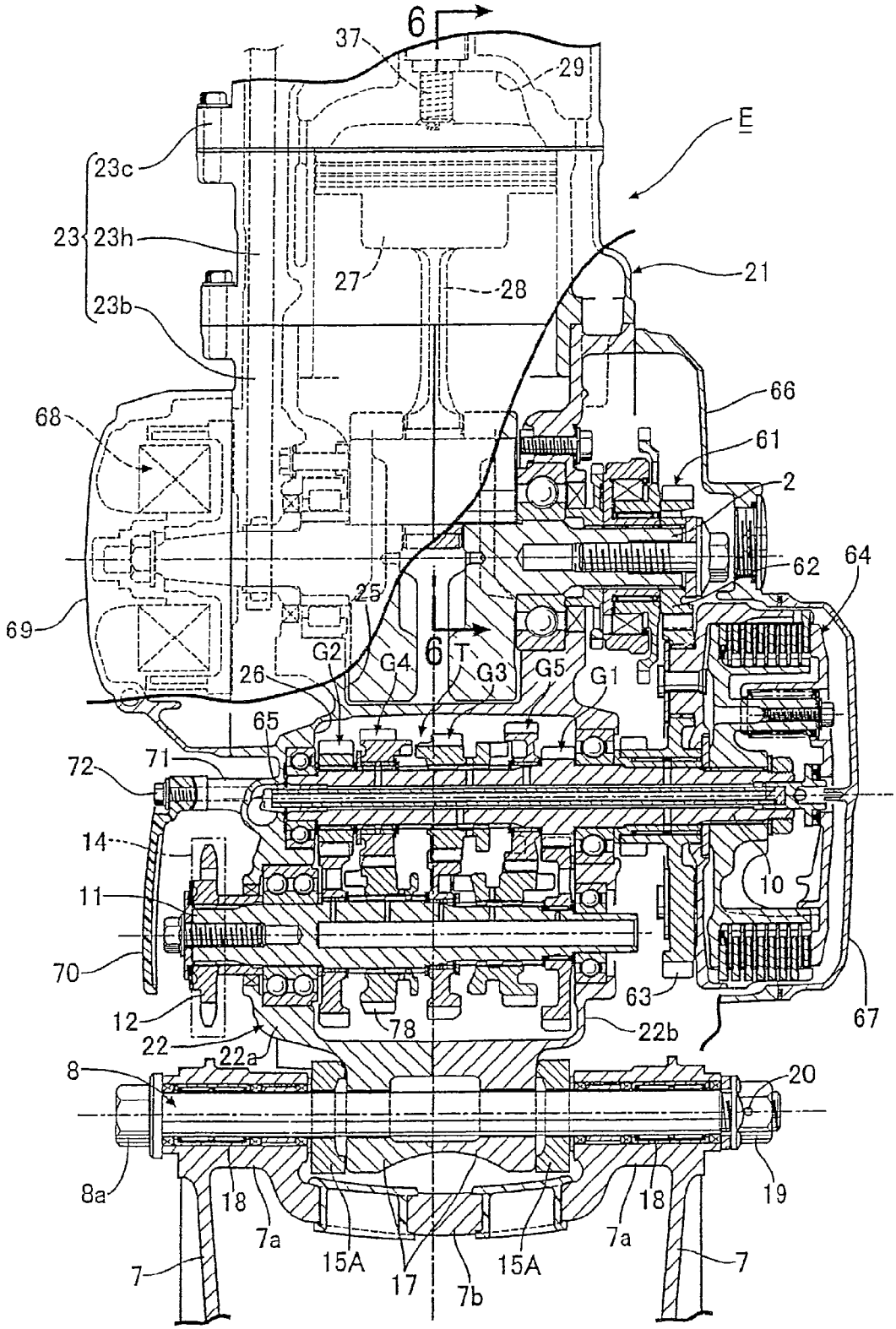
FIG. 4 is a sectional view taken along line 4-4 of FIG. 2.

Referring to FIGS. 2 and 4, items relating to support structure for the rear forks 7, 7 will be described in detail below.

A crankcase 22 of the engine E is integrally formed with a first hanger boss 17 projecting from a rear surface thereof. The pair of first engine hanger brackets 15A, 15A is disposed so as to clamp the first hanger boss 17 from the left and right sides. The pivot shaft 8 is passed through the first hanger boss 17 and the first engine hanger brackets 15A, 15A. The pivot shaft 8 has both its end portions extended outward beyond the left and right first engine hanger brackets 15A, 15A. Support bosses 7*a*, 7*a* at front end portions of the left-right pair of rear forks 7, 7 are supported on both the extended end portions of the pivot shaft 8 through needle bearings 18, 18. The pivot shaft 8 has at its one end a head portion 8*a* to be abutted on the outer end of the support boss 7*a* on one side, a nut 19 to be opposed to the outer end of the support boss 7*a* on the other side is screw engaged with the other end portion of the pivot shaft 8, and the nut 19 is fixed by a split pin 20. The left and right support bosses 7*a*, 7*a* are united to each other by a cross member 7*b*.

Thus, by the single pivot shaft 8, the first hanger boss 17 of the engine E and the first engine hanger brackets 15A, 15A of the body frame F are connected, and the left and right rear forks 7, 7 are swingably supported. In other words, the pivot shaft 8 plays two roles, i.e., the role of fixingly supporting the engine E onto the body frame F and the role of swingably supporting the rear forks 7, 7. In this manner, the pivot shaft 8 contributes to simplification of the structure. In addition, the rear forks 7, 7 are each supported by both the first hanger boss 17 and the first engine hanger bracket 15A through the pivot shaft 8, so that support rigidity thereof is enhanced.

Now, referring to FIGS. 2 to 4, the engine E will be described below.

The engine E is of a water-cooled 4-cycle system that includes an engine body 21, which is composed of the crankcase 22 and a cylinder 23 rising from a front portion of the crankcase 22. The crankcase 22 is composed of a left case half 22*a* and a right case half 22*b* which are formed individually and are bolt joined to each other at a vertical plane orthogonal to the axis of a crankshaft 2. The cylinder 23 is composed of a cylinder block 23*b* joined to an upper end surface of a front portion of the crankcase 22, a cylinder head 23*h* joined to the upper end of the cylinder block 23*b*, and a head cover 23*c* joined to the upper end of the cylinder head 23*h*. The rising of the cylinder 23 means the condition where the axis Y of the cylinder 23, or the center line of a cylinder bore 24, is set on a vertical line V or the condition where the axis Y is slanted to the front side at such an angle that it is nearer to the vertical line V than to a horizontal line H. The example shown in the drawings resides in the latter condition.

The interior of the crankcase 22 is partitioned into a crank chamber 25 directly under the cylinder 23, and a transmission chamber 26 aligned with and on the rear side of the crank chamber 25. The crank chamber 25 accommodates the crankshaft 2, while the transmission chamber 26 accommodates a multistage transmission T.

The cylinder block 23*b* is formed therein with a single cylinder bore 24, and a piston 27 fitted therein is connected to the crankshaft 2 through a connecting rod 28.

Figure 6:
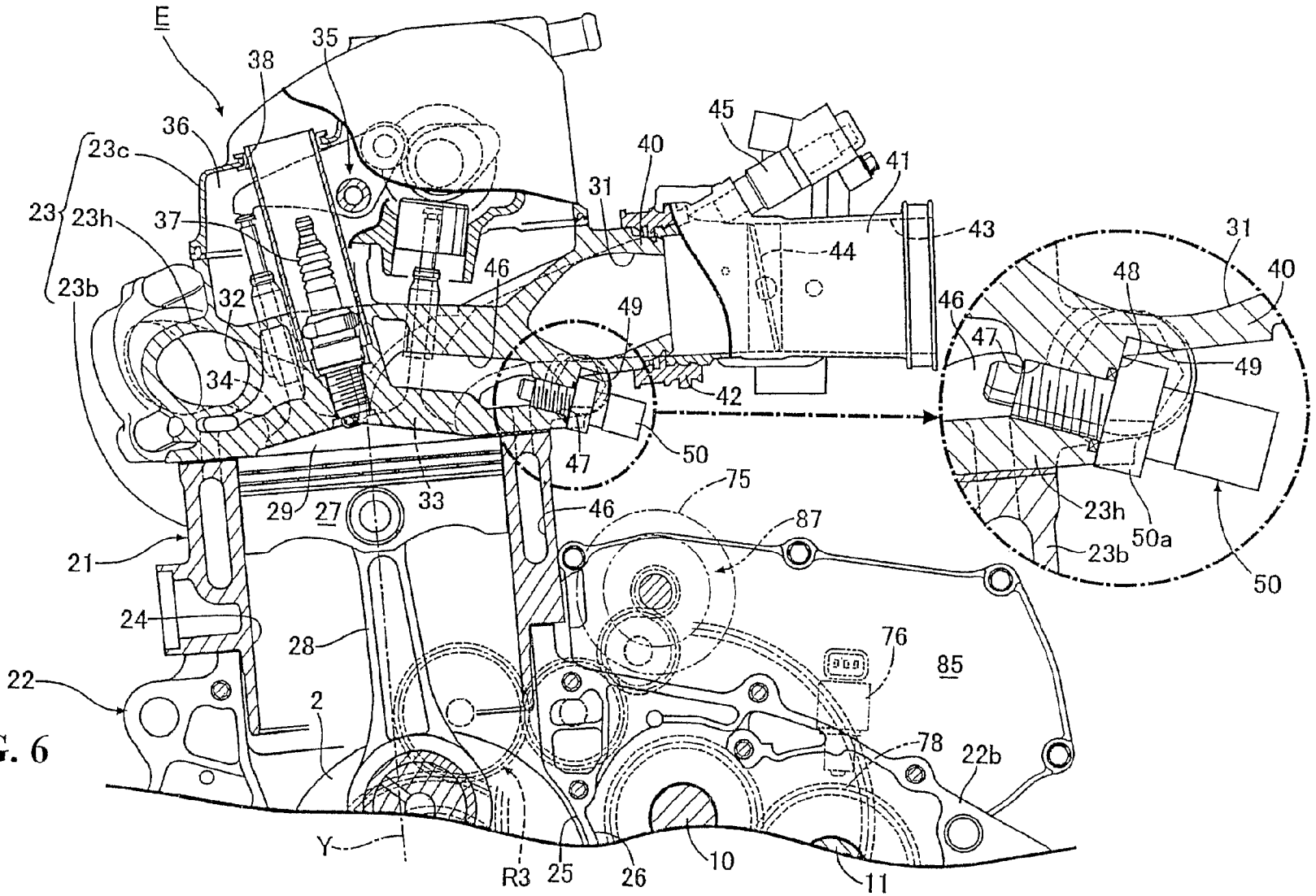
FIG. 6 is a sectional view taken along line 6-6 of FIG. 4.
Figure 7:
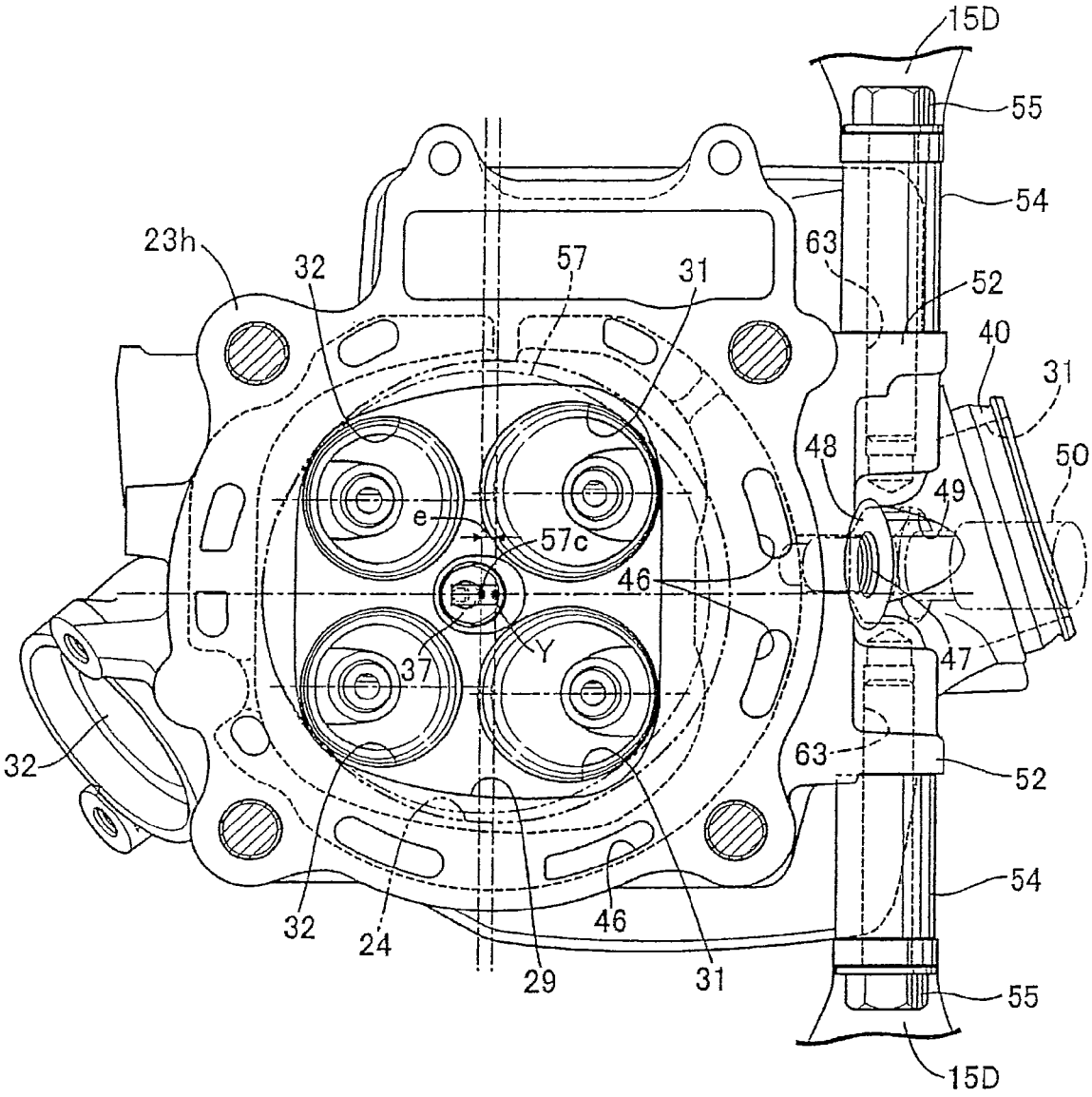
FIG. 7 is a sectional view taken along line 7-7 of FIG. 2.

In FIGS. 6 and 7, the cylinder head 23*h* is provided with a combustion chamber 29 communicating with the cylinder bore 24, and an intake port 31 and an exhaust port 32 which open into the combustion chamber 29. The intake and exhaust ports 31 and 32 are each bifurcated on the combustion chamber 29 side, before opening into the combustion chamber 29, and pairs of intake and exhaust valves 33 and 34 for opening/closing the opening ends are mounted to the cylinder head 23*h*. A valve system 35 for driving the intake and exhaust valves 33, 34 to open and close is arranged in a valve system chamber 36 defined between the cylinder head 23*h* and the head cover 23*c*.

A spark plug 37 is screw engaged to the cylinder head 23*h*, with its electrode fronting on that central zone of the combustion chamber 29 which is surrounded by the intake and exhaust valves 33, 34. The spark plug 37 is contained in a tubular plug guide 38, which penetrates the valve system chamber 36 vertically and is mounted to the cylinder head 23*h* and the head cover 23*c*.

The upstream end of the intake port 31 opens at an end face of an intake tube portion 40 integrally projectingly provided at a rear surface of the cylinder head 23*h*, and a throttle body 41 is connected to the intake tube portion 40 through an insulator ring 42. A throttle valve 44 for opening/closing an intake duct 43 continuous with the intake port 31, and a fuel injection valve 45 for injecting a fuel toward the intake port 31, are mounted to the throttle body 41.

The cylinder block 23*b* and the cylinder head 23*h* are equipped with a series of water jackets 46. A rear wall of the cylinder head 23*h* just under the intake tube portion 40 is provided with a first sensor mounting hole 47 penetrating the rear wall in the front-rear direction to reach the water jacket 46, and with a mounting seat 48 at which the outer end of the first sensor mounting hole 47 opens. In this case, the intake tube portion 40 is provided at its lower portion with a cutout-like counter sinking 49 so that a part of the mounting seat 48 ranges into the lower portion of the intake tube portion 40. A water temperature sensor 50 for detecting the temperature of water in the water jackets 46 is screw fitted into the first sensor mounting hole 47, and a fastening portion 50*a* thereof is put in firm contact with the mounting seat 48.

The water temperature sensor 50 mounted to the cylinder head 23*h* detects the water temperature in the cylinder head 23*h*, where temperature variations are comparatively large, among the water jackets 46 for the engine E, and sends a detection signal to an electronic control unit for controlling a fuel injection system, an ignition system and the like. Therefore, the fuel injection system, the ignition system and the like can be appropriately controlled in quick response to variations in the engine temperature. Moreover, since the water temperature sensor 50 mounted to the cylinder head 23*h* of the cylinder 23 set in the rising state is located at a high position of the engine E, debris or foreign matter such as stones, earth and sand, etc. that may fly from the lower side to the water temperature sensor 50 can be obviated as securely as possible.

In addition, the water temperature sensor 50 disposed directly under the intake tube portion 40 can be protected against contact therewith of debris or foreign matter coming from the upper side, by the intake tube portion 40 and the throttle body 41 connected thereto.

Further, the intake tube portion 40 is provided at its lower portion with the cutout-like counter sinking 49 so that a part of the mounting seat 48 ranges into the lower portion of the intake tube portion 40. As a result, a sufficiently broad mounting seat 48 for fastening the water temperature sensor 50 can be secured at the rear wall of the cylinder head 23*h* just under the intake tube portion 40, so that the water temperature sensor 50 can be attached assuredly, and the layout position of the water temperature sensor 50 can be raised as much as possible.

Now, referring to FIGS. 3 and 7, a further protective structure for the water temperature sensor 50 will be described.

The rear wall of the cylinder head 23*h* is integrally formed with a left-right pair of second hanger bosses 52, 52 which are opposed to each other, with the water temperature sensor 50 therebetween. In this case, the left and right second hanger bosses 52, 52 are united to each other through the intake tube portion 40. With this structure, both the second hanger bosses 52, 52 are reinforced by the intake tube portion 40. The second hanger bosses 52, 52 are provided with screw holes opening at left and right outer end surfaces thereof. Lower end portions of the left-right pair of fourth engine hanger brackets 15D, 15D mentioned above are laid over the second hanger bosses 52, 52 through distance collars 54, 54, and are secured in situ by bolts 55, 55 engaged with the screw holes. In addition, upper end portions of the fourth engine hanger brackets 15D, 15D are firmly attached to the body frame F by bolts 56, 56. The fourth engine hanger brackets 15D, 15D may preliminarily be welded to the body frame F. However, the configuration in which they can be attached to and detached from the body frame F as above-mentioned is advantageous from the viewpoint of mounting of the engine E onto the body frame F.

Thus, the water temperature sensor 50 interposed between the left and right fourth engine hanger brackets 15D, 15D can be protected from debris or foreign matter that may collide thereon that may come from the left or right outer side, by the pair of second hanger bosses 52, 52 and the fourth engine hanger brackets 15D, 15D.

In the above-mentioned manner, the water temperature sensor 50 can be protected from externally flying debris or foreign matter, without arranging any protective cover for exclusive use. This can contribute to ensuring the durability of the water temperature sensor 50 and to a reduction in cost.

In addition, in the combustion chamber 29, the opening portions of the intake port 31 and the exhaust port 32 which are opened/closed respectively by the intake valves 33 and the exhaust valves 34 are so laid out that the center 57*c* of a circle 57 circumscribed on the circumferencial edges of the opening portions has an offset (e) from the axis Y toward the side opposite to the side of the water temperature sensor 50. In short, the opening portions of the intake and exhaust ports 31, 32 into the combustion chamber 29 are laid out so that they as a whole are somewhat deviated toward the side opposite to the side of the water temperature sensor 50, within the combustion chamber 29. This layout ensures that the spacing between the opening portions of the intake port 31 into the combustion chamber 29 and the water temperature sensor 50 is widened, so that the internal volume of the water jacket 46 arranged therebetween can be set large. Accordingly, cooling water in the water jacket 46 can be prevented from stagnating around the water temperature sensor 50, and accurate detection of water temperature can be achieved.

Now, referring to FIGS. 2 and 4, the multistage transmission T and the peripheral structure will be described below.

The multistage transmission T contained in the transmission chamber 26 of the crankcase 22 has an input shaft 10 and an output shaft 11 which are supported in parallel to the crankshaft 2 by the crankcase 22. The output shaft 11 is laid out on the rear side of the input shaft 10, and the input shaft 10 is laid out above the crankshaft 2 and the output shaft 11. Such a layout makes it possible to render the crankcase 22 compact in the front-rear direction. Thus, the size of the engine E is more compact. Moreover, as above-mentioned, the crankcase 22 is composed of the left case half 22*a* and the right case half 22*b* which are joined to each other at the vertical plane orthogonal to the axis of the crankshaft 2. When the left case half 22*a* and the right case half 22*b* are joined to each other, therefore, both ends of each of the above-mentioned three shafts can be easily supported by the case halves 22*a*, 22*b*.

The input shaft 10 and the crankshaft 2 have their right end portions projecting to the outside of the crankcase 22, and a primary transmission 61 is provided between the right end portions. The primary transmission 61 is composed of a small-diameter drive gear 62 secured to the crankshaft 2, and a large-diameter driven gear 63 rotatably supported on the input shaft 10 and meshed with the drive gear 62. In addition, a clutch 64 for disengageably coupling the driven gear 63 and the input shaft 10 is mounted to the input shaft 10. A push rod 65 which ensures interlocking between a clutch lever provided at the steering handle 6 and a release member of the clutch 64 is arranged in a hollow portion of the input shaft 10. With the push rod 65 advanced and retracted by operating the clutch lever, the clutch 64 is changed over between an ON state for connecting the driven gear 63 and the input shaft 10 to each other and an OFF state for disconnecting the driven gear 63 and the input shaft 10 from each other.

A side cover 66 for covering the primary transmission 61 and an outer circumferential portion of the clutch 64 is bolted to a right side surface of the crankcase 22. In addition, a clutch cover 67 for covering an outer end face of the clutch 64 is joined to the side cover 66.

Further, a left end portion of the crankshaft 2 also projects to the outside of the crankcase 22. A generator 68 driven by the crankshaft 2 is mounted between the left end portion and the crankcase 22. A generator cover 69 for covering the generator 68 is joined to a left outside surface of the crankcase 22.

The transmission T further includes first-speed to fifth-speed gear trains G1 to G5 arranged between the input shaft 10 and the output shaft 11, and an arbitrary one of the gear trains is selectively established.

The output shaft 11 has its one end portion projected to the left outer side of the crankcase 22, and the above-mentioned drive sprocket 12 is secured to the one end portion. In addition, a synthetic resin-made sprocket cover 70 for covering the drive sprocket 12 is secured by bolts 72 to a plurality of mounting bosses 71 that project from the left outside surface of the crankcase 22.

Figure 3:
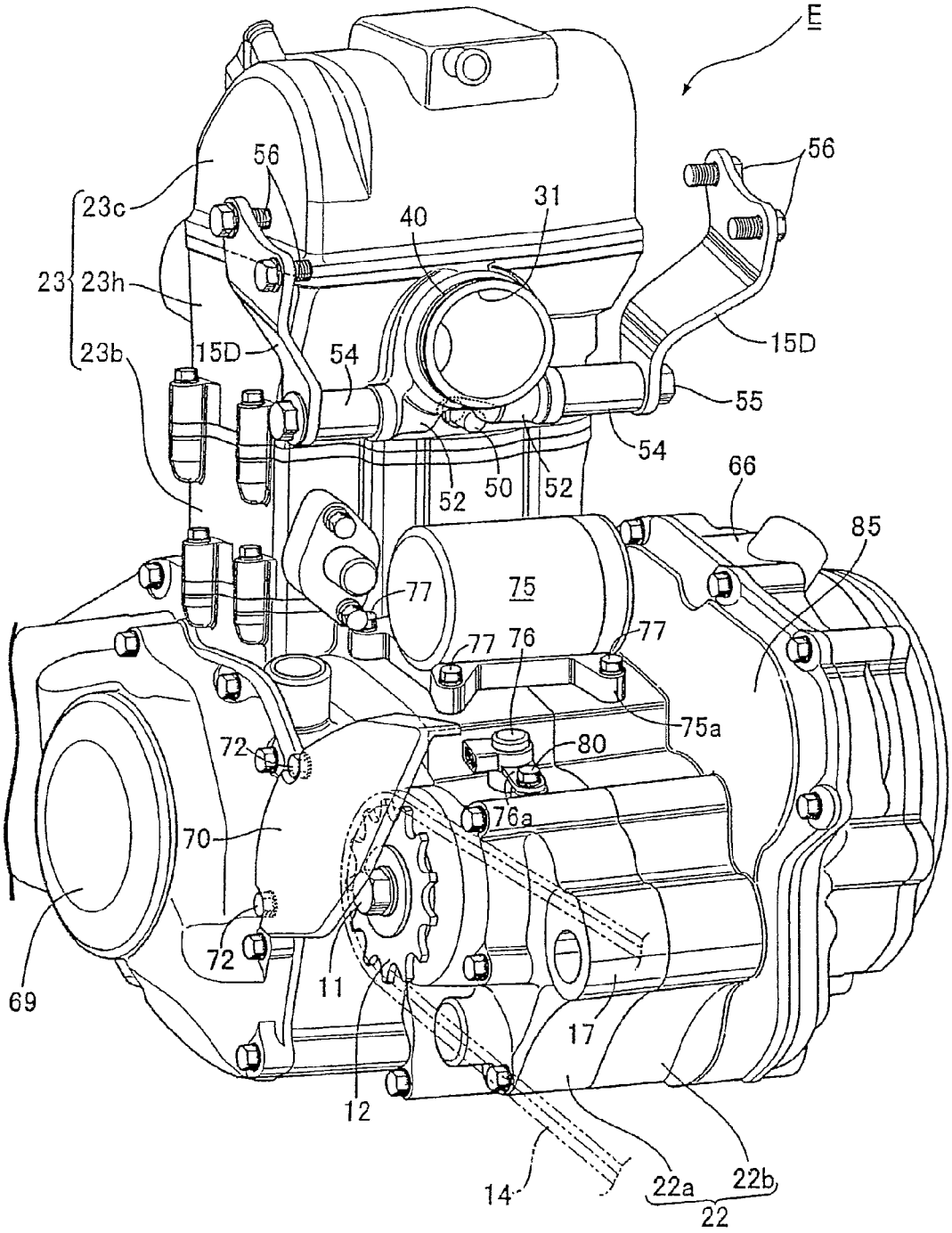
FIG. 3 is a perspective view of an engine shown in FIG. 2.
Figure 5:
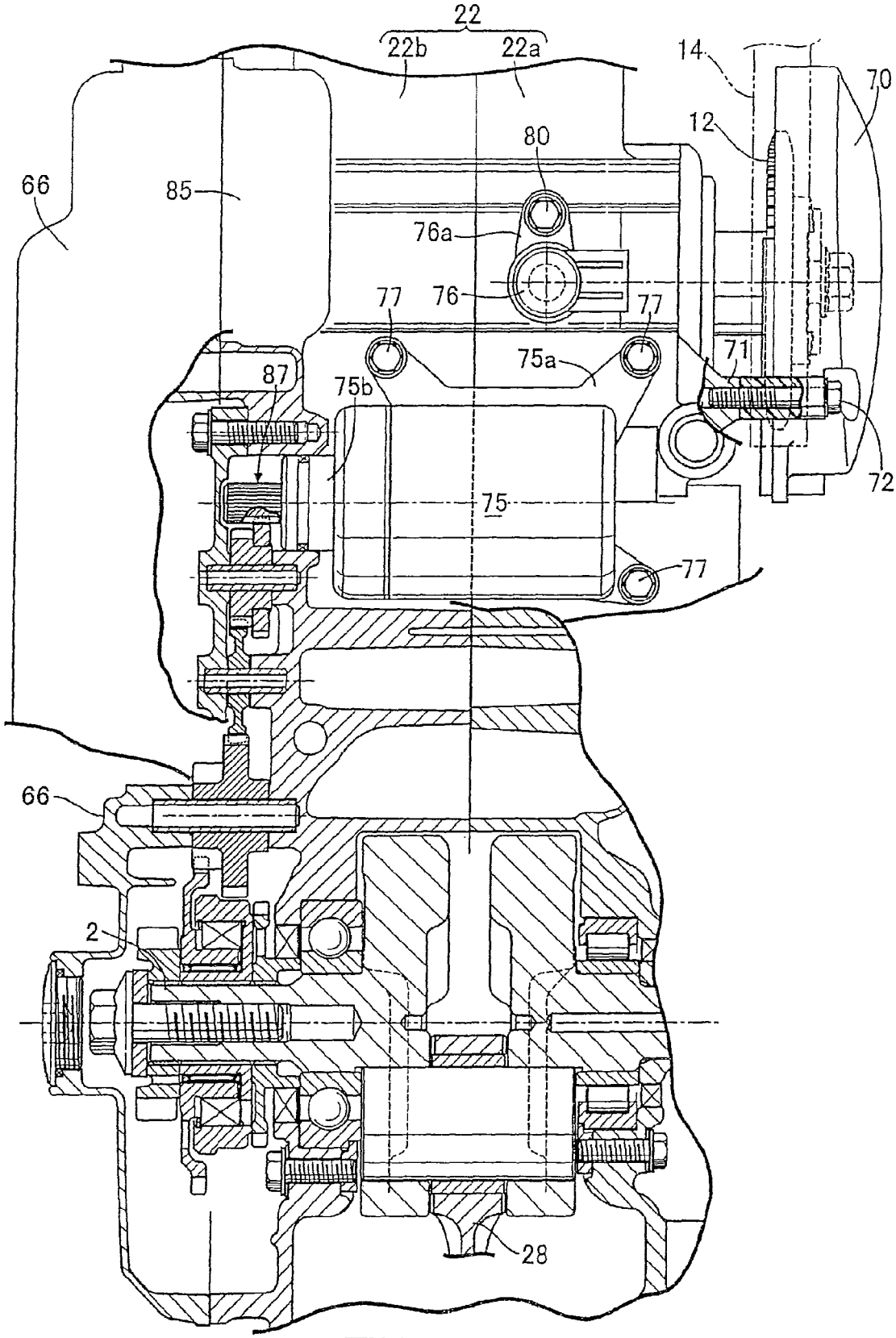
FIG. 5 is a sectional view taken along line 5-5 of FIG. 2.

As shown in FIGS. 2, 3 and 5, a starter motor 75 and a speed sensor 76 disposed just at the rear of the starter motor 75 are attached to an upper surface of the crankcase 22 projecting to the rear side of the cylinder 23. In addition, the cylinder 23 is so laid out that its axis Y has an offset of a predetermined distance (s) from the center of the crankshaft 2 toward the side opposite to the side of the starter motor 75. Such a layout of the cylinder 23 ensures that the upper surface, projecting to the rear side of the cylinder 23, of the crankcase 22 is broadened for facilitating the arrangement of the starter motor 75 and the speed sensor 76 onto the projecting upper surface.

As clearly shown in FIG. 2, on the upper surface of the crankcase 22, the starter motor 75 is arranged at a portion directly above the input shaft 10, while the speed sensor 76 is arranged at a portion directly above the output shaft 11. In addition, a mounting flange 75*a* of the starter motor 75 is secured to the crankcase 22 by bolts 77.

On the other hand, the speed sensor 76 is arranged so as to detect as the vehicle speed the rotating speed of a gear 78 which is provided on the output shaft 11 and rotated as one body with the output shaft 11, in the example shown, a driven gear 78 in the fourth-speed gear train G4. More specifically, a second sensor mounting hole 81 opening toward a tooth portion of the gear 78 is provided in an upper wall of the crankcase 22, and a mounting flange 76*a* is secured by a bolt 80 to a boss 79 projectingly provided at the upper surface of the crankcase 22 in the condition where the speed sensor 76 is fitted in the second sensor mounting hole 81 and a sensing portion at its tip is set close to the tooth portion of the gear 78.

At a right end portion of the crankcase 22, a raised wall 85 is formed which rises from the upper surface of the crankcase 22 and covers a right side surface of the speed sensor 76. The raised wall 85 constitutes a joining portion for the side cover 66, and a starting transmission 87 for transmitting a driving force of the starter motor 75 to the crankshaft 2 and, optionally, a kick starter mechanism or the like are contained in a space 86 between the raised wall 85 and the side cover 66.

In addition, the sprocket cover 70 has its upper end projecting to the upper side of the crankcase 22 that overlaps with at least a part of a left side surface of the speed sensor 76 in a side view.

Thus, the speed sensor 76 is covered and protected by the raised wall 85 and the sprocket cover 70 on both the left and right outer sides thereof, so that debris or foreign matter such as flying stones, earth and sand, etc. can be prevented from impacting with the speed sensor 76 from the left or right outer side.

Since the input shaft 10 is laid out above the crankshaft 2 and the output shaft 11 so as to render the crankcase 22 compact as above-mentioned, the upper surface of the crankcase 22 is narrow. However, since the starter motor 75 is laid out at a portion, just above the input shaft 10, of the upper surface of the crankcase 22 and the speed sensor 76 is laid out at a portion, just above the output shaft 11, of the upper surface of the crankshaft 22, the space efficiency for the layout is good, and an increase in the size of the engine E due to the arrangement of the starter motor 75 and the speed sensor 76 can be obviated.

In addition, since the speed sensor 76 disposed at a portion just above the output shaft 11 is spaced sufficiently from the cylinder 23, it is less liable to be influenced by the heat of the cylinder 23.

Further, the speed sensor 76 is protected also on both the left and right sides thereof by the raised wall 85 of the crankcase 22 and the sprocket cover 70, so that debris or foreign matter such as flying stones, earth and sand, etc. can be prevented from impacting with the speed sensor 76 from the left or right outer side.

In addition, since the speed sensor 76 is arranged on the upper surface of the crankcase 22, debris or foreign matter can be prevented from impacting with the speed sensor 76 from the rear side by the first hanger boss 17 projecting at the rear side of the crankcase 22 and by the left and right rear forks 7, 7 swingably supported on the first hanger boss 17 through the pivot shaft 8, as above-mentioned. Therefore, there is no need for a protective cover used exclusively for the speed sensor 76.

While an embodiment of the present invention has been described above, the invention is not limited to the above embodiment, and various design modifications are possible within the scope of the gist of the invention. For example, the present invention is applicable also to engines of other vehicles than the four-wheel buggy, such as motorcycles and motor tricycles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A vehicle engine mounted on a body frame, comprising:

a crankcase for supporting thereon a crankshaft, an input shaft of a transmission, and an output shaft, disposed on the rear side of said input shaft, of said transmission, said crankcase including a left case half and a right case half jointed to each other at a plane orthogonal to the axis of said crankshaft;

a starter motor being mounted to an upper surface of the crankcase;

a speed sensor, for detecting the vehicle speed from rotation of a gear in said transmission, being mounted to the upper surface of said crankcase;

wherein said starter motor is disposed on a portion, directly above said input shaft of said upper surface of said crankcase, said speed sensor for detecting the rotation of a gear on said output shaft as the vehicle speed is disposed on a portion, directly above said output shaft, of said upper surface of said crankcase, and said crankcase is formed with a raised wall for covering one side surface of said speed sensor.

2. The vehicle engine according to claim 1, wherein a drive sprocket for driving a rear wheel is firmly attached to an end portion, projecting to the outer side of said crankcase, of said output shaft, a sprocket cover for covering an outside surface of said drive sprocket is mounted to said crankcase, and said sprocket cover is configured to overlap with at least a part of the other side surface of said speed sensor in side view.

3. The vehicle engine according to claim 1, wherein a cylinder rising from an upper surface of a front portion of said crankcase is so disposed that an axis thereof has an offset from the center of said crankshaft toward the side opposite to the side of said starter motor.

4. The vehicle engine according to claim 1, wherein a hanger boss connected to an engine hanger bracket provided on said body frame is formed at a rear surface of said crankcase located on the rear side of said output shaft, and a rear fork for supporting a rear wheel is swingably supported on said hanger boss and said engine hanger bracket.

5. The vehicle engine according to claim 1, wherein said speed sensor is operatively mounted within a mounting opening for positioning the speed sensor towards a tooth portion of the gear provided in an upper wall of the crankcase.

6. The vehicle engine according to claim 5, and further including a mounting flange mounted on a boss projecting from an upper surface of the crankcase, said speed sensor being positioned on said mounting flange with a sensing portion disposed at a tip of the speed sensor being set close to the tooth portion of the gear.

7. The vehicle engine according to claim 2, wherein the sprocket cover includes an upper end projecting to an upper side of the crankcase towards the raised wall for overlapping with at least the part of the other side surface of the speed sensor in a side view.

8. The vehicle engine according to claim 7, wherein the speed sensor is protected from debris by the raised wall on one side of the speed sensor and the sprocket cover with the upper end projecting towards the raised wall on the other side of the speed sensor.

9. The vehicle engine according to claim 1, wherein positioning the input shaft to be above the crankshaft and the output shaft, the crankcase is compact and the upper surface of the crankcase is narrow with the positioning of the starter motor just above the input shaft on the upper surface of the crankcase and the speed sensor being positioned at a portion just above the output shaft on the upper surface a space efficiency enhanced and an increase in a size of the motor is obviated.

10. The vehicle engine according to claim 4, wherein the speed sensor is protected from debris from a rear side by the hanger boss projecting upwardly from the crankcase to the rear of the speed sensor.

11. A vehicle engine comprising:

a crankcase;

a crankshaft operatively supporting for rotation relative to said crankcase;

an input shaft of a transmission;

an output shaft of the transmission, said output shaft being disposed on the rear side of said input shaft;

said crankcase including a left case half and a right case half jointed to each other at a plane orthogonal to the axis of said crankshaft;

a starter motor being mounted to an upper surface of the crankcase;

a speed sensor, for detecting the vehicle speed from rotation of a gear in said transmission, said speed sensor being mounted to an upper surface of said crankcase;

said starter motor is disposed on the upper portion of said crankcase directly above said input shaft;

said speed sensor for detecting the rotation of a gear on said output shaft as the vehicle speed is disposed on the upper portion of the crankcase directly above said output shaft; and a raise wall being formed to project upwardwardly from said upper surface of said crankcase, said raised wall covering one side surface of said speed sensor.

12. The vehicle engine according to claim 11, wherein a drive sprocket for driving a rear wheel is firmly attached to an end portion, projecting to the outer side of said crankcase, of said output shaft, a sprocket cover for covering an outside surface of said drive sprocket is mounted to said crankcase, and said sprocket cover is configured to overlap with at least a part of the other side surface of said speed sensor in side view.

13. The vehicle engine according to claim 11, wherein a cylinder rising from an upper surface of a front portion of said crankcase is disposed wherein an axis thereof has an offset from the center of said crankshaft toward the side opposite to the side of said starter motor.

14. The vehicle engine according to claim 11, wherein a hanger boss connected to an engine hanger bracket provided on said body frame is formed at a rear surface of said crankcase located on the rear side of said output shaft, and a rear fork for supporting a rear wheel is swingably supported on said hanger boss and said engine hanger bracket.

15. The vehicle engine according to claim 11, wherein said speed sensor is operatively mounted within a mounting opening for positioning the speed sensor towards a tooth portion of the gear provided in an upper wall of the crankcase.

16. The vehicle engine according to claim 15, and further including a mounting flange mounted on a boss projecting from an upper surface of the crankcase, said speed sensor being positioned on said mounting flange with a sensing portion disposed at a tip of the speed sensor being set close to the tooth portion of the gear.

17. The vehicle engine according to claim 12, wherein the sprocket cover includes an upper end projecting to an upper side of the crankcase towards the raised wall for overlapping with at least the part of the other side surface of the speed sensor in a side view.

18. The vehicle engine according to claim 17, wherein the speed sensor is protected from debris by the raised wall on one side of the speed sensor and the sprocket cover with the upper end projecting towards the raised wall on the other side of the speed sensor.

19. The vehicle engine according to claim 11, wherein positioning the input shaft to be above the crankshaft and the output shaft, the crankcase is compact and the upper surface of the crankcase is narrow with the positioning of the starter motor just above the input shaft on the upper surface of the crankcase and the speed sensor being positioned at a portion just above the output shaft on the upper surface a space efficiency enhanced and an increase in a size of the motor is obviated.

20. The vehicle engine according to claim 14, wherein the speed sensor is protected from debris from a rear side by the hanger boss projecting upwardly from the crankcase to the rear of the speed sensor.

* * * * *